US010625123B2

(12) United States Patent
Liu

(10) Patent No.: US 10,625,123 B2
(45) Date of Patent: Apr. 21, 2020

(54) RACKET STRINGING APPARATUS WITH CROSS STRING AID

(71) Applicant: Haisheng Liu, Hudson, OH (US)

(72) Inventor: Haisheng Liu, Hudson, OH (US)

( * ) Notice: Subject to any disclaimer, the term of this patent is extended or adjusted under 35 U.S.C. 154(b) by 0 days.

(21) Appl. No.: 15/989,696

(22) Filed: May 25, 2018

(65) Prior Publication Data

US 2019/0358501 A1 Nov. 28, 2019

(51) Int. Cl.
*A63B 51/14* (2006.01)

(52) U.S. Cl.
CPC ..... *A63B 51/14* (2013.01); *A63B 2051/146* (2013.01)

(58) Field of Classification Search
CPC ..... A63B 51/00; A63B 51/14; A63B 51/16; A63B 2051/146
See application file for complete search history.

(56) References Cited

U.S. PATENT DOCUMENTS 3,994,496 A 11/1976 Burchett
4,270,752 A 6/1981 Strelow
4,339,131 A 7/1982 Balaban
4,491,322 A * 1/1985 Heilman ..... A63B 51/14 473/556
4,706,955 A * 11/1987 Ngadi ..... A63B 51/16 473/555
4,846,474 A * 7/1989 Chiang ..... A63B 51/14 473/555
5,568,921 A * 10/1996 Lorentzen ..... A63B 51/14 473/556
5,590,877 A * 1/1997 Ho ..... A63B 51/16 473/556
6,764,418 B1 * 7/2004 Lee ..... A63B 51/14 473/557
2015/0133243 A1 * 5/2015 Zdrazila ..... A63B 51/16 473/556

FOREIGN PATENT DOCUMENTS

WO 2013127375 A1 9/2013

OTHER PUBLICATIONS

Stringway, "Instructions Manual of the Stringway Cross Stringing Tools", website: https://www.stringway-stringing-machines.com/ The Netherlands.
Mutual Power, "Mutual Power Titan 7600 Stringing Maching", website: http://www.eagnasinc.com/maxgen/t7600.html.

* cited by examiner

*Primary Examiner* — Raleigh W Chiu
(74) *Attorney, Agent, or Firm* — Jacob M. Ward; Ward Law Office LLC

(57) ABSTRACT

A first improvement to racket stringing machines, for the sport racquets in badminton, tennis, racquetball, and squash/etc. sports, includes a tensioning of two opposite strings with one string tensioning mechanism. A movable base for the racket mounting mechanism is used to link the two ends of tensioning mechanism together and achieve the object to string two strings with one action of string tensioning mechanism. A second improvement is specific for the drop weight tensioning method and includes a moving of the support frame of the drop weight, instead of the rotating the drop weight. A third improvement includes a cross-stringing aid for weaving the cross string during the stringing process. Each of these improvements, either alone or together, are believed to speed up the stringing process so that it is much faster than convention stringing equipment.

11 Claims, 16 Drawing Sheets

RACKET STRINGING APPARATUS WITH CROSS STRING AID

FIELD

The disclosure generally relates to a stringing or string-stretching device and, in particular, to a string tensioning device of the sort that may be used to tension strings of a sport racquet for tennis, badminton, racquetball, and squash sports.

BACKGROUND

According to the current state of the art, stringing of a sports racquet, and installing the strings onto the racquet, is done manually with the help of a stringing machine. Known stringing machines are usually constructed with three main components: a racket mounting mechanism; a string tensioning mechanism; and a string clamping mechanism.

Typically, the racket mounting mechanism is used to hold the racket in a horizontal flat position during the stringing process and can be rotated horizontally in a full circle.

The string tensioning mechanism is a device used to tension the string, i.e., for pulling the string to the desired tension. The tensioning mechanism can function according to one of several known methods including drop weight, mechanic manual crank, electric, and electronic design. The components are usually fixed on the same common platform base of the stringing machine, so that the tension on the string can be created between them when the string is being tensioned.

The string clamping mechanism is used to hold string tension when switching strings. Commonly, it is one piece of string running back and forth multiple times on the racket either longitudinal or cross, or both.

As used herein, the singular term "string" refers to the string section between the two grommet holes, running longitude or cross on the racket head. The plural term "strings" as used herein refers to the all of strings inside racket between the two grommet holes, even though it is usually only one or two pieces of strings running through all the grommet holes for the whole racket.

Since the support frame of the string tensioning mechanism is normally at a fixed position relatively to the racket mounting mechanism, the stringing process is usually done on one string at a time. For each string, there are several steps to be completed repeatedly, namely: gripping the string on to the string tensioning mechanism; tensioning the string with the string tensioning mechanism; clamping the string by the clamp; de-gripping the string from the string tensioning mechanism; rotating the racket mounting system 180 degrees so the next string will be on the side of the string tensioning mechanism; threading the string through the grommet holes and weaving the cross string if the string is a cross string; and then repeating all of the steps above for this string. These steps are repeated for about 30 to 50 times, depending on type of racket, for stringing of a single racket. If it were possible to reduce even one step, or to simplify a step of the stringing method, it would save time and speed up the stringing process.

Among all the known tensioning methods mentioned above, each one has its own advantage and disadvantage. The drop weight method is simple in design, low cost, and hard to operate. It is commonly found on the low-end stringing machines. On the other end, the electronic tensioning mechanism can be operated by just one touch of a switch for tensioning, but is complicated in design, and very expensive. It is usually on a high-end stringing machine. The electronic tensioning mechanism can string a racket much faster than the drop weight type machine. The stringing machine with a mechanical manual crank is usually between the drop weight and electronic methods in efficiency. This is due to its design having a spring load inside which makes it need calibration periodically.

The mechanical manual crank also uses a locking mechanism to hold string after tensioning, and there is not a constant pulling (i.e., the string being tensioned is always under pulling force) compared to the electronic tensioning mechanism or drop weight tensioning mechanism (i.e., the string after being tensioned and, if held at fixed distance, the tension of string will drop a little bit with time.). The electric one (different from electronic tensioning method) uses the motor directly. It cannot achieve the uniform tension for every tensioning operation due to its design principle.

The drop weight stringing machine is usually constructed with a drop weight/bar, a horizontal axis for the drop weight to rotate up/down, a clutch or string grip/re-grip mechanism, and a support frame to hold these together. It utilizes the gravity force of the drop weight to pull the string. When the drop weight/bar reaches the horizontal position, the desired tension for the string is obtained. The support frame of the drop weight assembly is usually fixed to the common platform base of whole stringing machine, which is also the common platform of the racket mounting system.

Due to this design of a fixed support frame and its use of gravity to achieve the specific tension, after the gripping of the string, it is almost impossible to have the drop weight/bar reach the level position on the first try. When stringing, the clutch or string grip/re-grip mechanism must be adjusted to achieve the horizontal position of the drop weight/bar to obtain a desired tension on string. This adjustment of the string with the clutch or grip/re-grip mechanism usually needs several tries to get the drop weight/bar in the horizontal position. This is one of the most time-consuming parts of using the drop weight stringing machine.

If the adjustment is instead done by gripping/re-gripping the strings, it also may cause damage to the string. In fact, all these adjustments do is change the length of string on the pulley of the drop weight mechanism to achieve the desired tension on string, the drop weight bar in horizontal position, and certain string length between the racket and the pulley of the drop weight simultaneously.

Usually, the stringing process begins with the main/longitudinal strings, which is along the shaft direction of the racquet and will be called herein "main strings," on the frame head. After the main strings have been installed and tensioned, the cross strings, which are perpendicular to the main strings, are installed by threading through a side grommet hole in racket, weaving through the main strings in the manner of a sinuous wave format, and threading through a grommet hole of other side out of racket. Here, the weaving of the cross string through the main strings means the cross strings go to a different side of the main strings, up in one main string and then down for next main string, etc. This process is normally performed by the fingers of the stringer—who push the cross string up and down (on the stringing machine) alternatively through the main strings, which requires significant skill and is time-consuming.

In this process, it is necessary to tension the main strings before weaving the cross strings, because it is almost impossible to weave the cross strings when the main strings are not tensioned in this manner, i.e., it will take even longer to thread the cross strings when the main strings are not tensioned. Pulling the cross strings through with tensioned main strings can cause heat to be generated by the friction between the main and cross strings. The heat generated can damage the main strings, i.e., the entire length of the cross string will rub the one spot of main strings. This effect is known as "heat burning."

To avoid heat burning, when pulling the cross strings, the pulling must be slow and/or move the cross strings around main strings to a different position. For the badminton racket, after the main strings are tensioned, it is difficult to insert the cross string through the shared grommet hole due to the tensioned main string. Also, it is hard to move the tensioned main string in the grommet hole to generate space for the cross string to get through the same grommet hole. Commonly, an awl is used to help create some space in the grommet hole for the cross string to be inserted through the same grommet hole. However, this increases the probability of damaging the main string, which is already tensioned.

Various devices and products have been proposed to facilitate the placing/weaving of the cross strings and provide a clear spacing for the cross strings to pass through easily by displacing main strings in opposite directions, perpendicularly to the plane of the racquet head, and alternate main strings. Non-limiting examples are certain devices from Stringway Inc., a Dutch manufacturer of stringing machines, and devices described in U.S. Pat. Nos. 4,339,131, 4,270,752, and 3,994,496, and the device described in International Publication No. WO2013127375.

These known devices and associated methods will displace the main strings in the direction perpendicular to the main strings and racket plane surface for each crossing string as shown in FIG. 2. These devices put extra stress on the main strings due to the displacement perpendicular to the main strings. The extra stress may damage the main strings or reduce their lifespan. Also, some of these devices need proper alignment on the main strings before starting, which takes additional effort to do it.

Due to these draw backs, these designs have not found wide acceptance. Consequently, the conventional cross strings weaving technique that uses the fingers of a stringer is still commonly used during the racquet stringing. This requires significant skill and is time-consuming.

There is a continuing need for an apparatus and method for stringing a racket that is more efficient and less time-consuming relative to the prior art.

SUMMARY

In concordance with the instant disclosure, an apparatus and method for stringing a racket that is more efficient and less time-consuming relative to the prior art, is surprisingly discovered. An objective of the present disclosure is to improve the efficiency of stringing a racket with a simple design that is more convenient to use.

There are three major improvements in the present disclosure. The first one is to tension two strings on the opposite sides of the racket with one tensioning action of the string tensioning mechanism. The second is to increase the operation efficiency of the drop weight method to a level that is almost the same as the high-end electronic tensioning mechanism. The third is an efficient solution of weaving the cross strings through the main strings. Accordingly, the present disclosure approaches the problems of re-stringing a racket in a new perspective that is substantially different from prior art in the field.

To achieve the first improvement, which involves tensioning the two strings in the opposite direction simultaneously, the base of the racket mounting mechanism is configured to be movable in the horizontal direction toward the string tensioning mechanism, instead of being in a fixed position relative to the racket mounting system, as in the prior art. Another string grip clamp is also added at a fixed position on the opposite side of the tensioning mechanism across the racket mounting system. When stringing a string with these changes relative to known stringing machines, the one end of the string will be threaded through the grommet hole of racket and installed on the newly added clamp on the opposite direction of the tensioning mechanism to be held firmly. The other end of the same string will be threaded through the grommet hole of the racket on the opposite side and installed on the string gripper of the tensioning mechanism.

When applying tension to the string by the tensioning mechanism, the string tensioning mechanism will pull the string on its side and due to the nature of the movable base of the racket mounting system, this tensioning force will be transferred to the other side of the racket. So, it will also pull the string on the other opposite side of the string tensioning mechanism with the clamp on its side. Until both sides reach the same tension force, the movable base will stop moving and stand still in the balance position. This results in both strings on the two sides tensioned at same time. The only difference of the tensioning force between two sides is the friction force between the movable base of the racket mounting system and the common platform base of stringing machine.

It should be appreciated that this mechanism may be applied to any type of stringing method, including drop weight, mechanic manual crank, electric, and electronic tensioning methods. Important differences of the stringing machine relative to the prior art are the movable base of the racket mounting system and the fixed clamp on the opposite side of the tensioning mechanism. Another advantage of this configuration is that neither the racket mounting mechanism nor the racket have to rotate 180 after one string is tensioned like in the prior art.

The second improvement of the present disclosure solves the problem of the inconvenient operation of the prior art drop weight stringing machine, by making the support frame of the drop weight assembly movable relative to the base of the string tensioning mechanism assembly. The main mechanism for the drop weight method to work is achieving the desired tension on the string being tensioned; the drop weight/bar being in a level position, and the string length of the string between the string tensioning mechanism and the racket mounting mechanism being at a mutual balanced point, all simultaneously. By making the support frame of the drop weight assembly movable on the base of the string tensioning mechanism, the horizontal/leveling position of drop weight/bar can be achieved by linearly moving the support frame of the drop weight assembly along the string tensioning direction, instead of a manual rotation of the drop weight/bar and the adjustment of the clutch or the string grip/re-grip method as known in the prior art. This makes it much easier to achieve the above-mentioned three requirements simultaneously, by just moving the support frame of the drop weight tensioning mechanism.

So, the changes for this improvement are to make the support frame of the drop weight assembly movable along the tensioning direction, instead of having a fixed support frame as in the prior art. The movement of the support frame of the drop weight assembly could be obtained by manual mechanics with a handle and gears or by an electronic motor and its related control circuits to start and stop the tensioning process. With proper design, the electric motor moving method can achieve almost same convenience as the high-end electronic stringing machine by being able to operate it with just one touch of switch.

It should be appreciated that, while this approach does increase some complexity of the stringing machine, it makes the operation of the stringing machine more convenient. Due to the movable base of the drop weight/bar assembly, the clutch or any other mechanisms used to adjust the position of the drop weight are unnecessary. This novel drop weight tensioning mechanism, has greater reliability than the complicated electronic tensioning mechanism, which will reduce the long-term maintenance cost of the stringing machine.

For the third improvement, the present disclosure approaches the problem of weaving the cross strings from a new perspective that is substantially different from the prior art. The basic method of the present disclosure is as follows.

A pre-weaved pattern of an assistant string is created. This pre-weaved pattern of an assistant string will be used to guide the weaving of crossing strings when installing the cross strings, after the main strings are in installed.

The pre-weaved pattern of the assistant strings may be formed either off the racket, for example, on a series of cut tubes, or on the racket during the process of installing main strings with help of looming tools.

After the pre-weaved assistant strings are on the racket with main strings installed, the cross string can be installed by: a) threading through the grommet hole from outside to inside of the racket, b) using the assistant strings to hook it up and pulling through the main strings (so the pre-weaved pattern on the assistant strings will be transferred to the cross string), and c) threading it through the grommet hole of other opposite side of racket.

Since it is not necessary to tension the main strings when installing the cross strings, the cross strings can be installed/weaved before the main strings are tensioned, unlike the prior art weaving of the cross strings by the fingers of the stringer. This reduces the pressure between the main strings and the cross strings when they are pulled through the main strings, which is known to be the main cause for the heat burning during the pulling of cross strings. So, the present disclosure will minimize the damage to the main strings by heat burning. Compared to prior art in this field, there is no need to displace the main strings in the perpendicular direction when they are tensioned. The accuracy of the tension of both the main and cross strings will be preserved as the setting of the stringing machine. Also, the pre-weaved pattern will not over-stress the main strings, which will avoid possible damage to the main strings due to the displacement of the main strings.

Other objects and features will become apparent for the design of the stringing machine in view of following text and pointed out hereinafter.

In a one embodiment, a racket stringing machine, for sport racquets in badminton, tennis, racquetball, and squash, etc. is designed with three improved techniques to increase the efficiency of the stringing machine relative to the prior art, and to speed up the process of re-stringing a racket. The first improvement is to tension two opposite strings with one string tensioning mechanism. A movable base for the racket mounting mechanism is used to link the two ends of tensioning mechanism together and achieve the objective of stringing two strings with one action of the string tensioning mechanism. This improvement can be applied to any tensioning method (i.e., drop weight; mechanical cranking; and electronic tensioning method).

In another embodiment, the second improvement is specific for the drop weight method. With the movable support frame for the drop weight tensioning mechanism, the strings can be tensioned and the drop weight/bar moved to the proper position much more quickly and easily by moving the support frame of the drop weight, instead of the rotating the drop weight. This improvement makes operation of a stringing machine with the drop weight tensioning mechanism much easier to use. Basically, this improvement achieves the same effect as with electronic tensioning mechanisms, but with a much simpler linear actuator motor system.

In a further embodiment, the third improvement is for weaving the cross string during the stringing process. A pre-weaving pattern of an assistant string being made ready before the starting of the stringing process for the cross strings, makes weaving the cross string much easier.

In yet another embodiment, a stringing apparatus for a racket includes a common platform base, a movable racket mounting system, a linkage mechanism, a tensioning head, and a standing fixed clamp. The movable racket mounting system is disposed on the common platform base. The linkage mechanism is disposed between the racket mounting system and the common platform base. The tensioning head is disposed on one side of the movable racket mounting system. The standing fixed clamp is disposed on another side of the movable racket mounting system.

The movable racket mounting system may be a movable or float mechanism configured to transfer a tension force from one side of a racket to another side of a racket. The movable racket mounting system may include a plurality of rolling balls or wheels. The linkage mechanism may be configured to limit the movement of the racket mount system in only a predetermined direction or rotation and a predetermined linear direction. The standing fixed clamp may be disposed on the common platform base and configured to secure a string of a racket on a side of the movable racket mounting adjacent to the standing fixed clamp. The tensioning head may be disposed on the common platform base and configured to hold the string of the racket on a side of the movable racket mounting system adjacent to the tensioning head and to apply tension to the string. The movable racket mounting system may be configured to pull a racket disposed on the racket mounting system toward the tensioning head and pull a string disposed between the racket and the standing clamp to cause an increased tensioning of the string. The racket mounting system may only be rotatable on the common platform base and is not linearly movable.

The stringing apparatus may also have a movable plate disposed between the racket mounting system and the common platform base. The movable plate is movable along one direction linearly relative to the racket mounting system and the common platform base. The tensioning head and the standing fixed clamp may be disposed on the movable plate.

In yet a further embodiment, a drop weight mechanism for a stringing apparatus includes a linearly movable support frame for the drop weight/bar string tension mechanism; a drop weight/bar string tension mechanism; and a motor actuator. The drop weight/bar string tension mechanism is disposed on the support frame. The motor actuator is configured to selectively and linearly move the support frame.

The linearly movable support frame may be configured to permit a change to a relative effective distance between a racket mounting mechanism and the drop weight/bar string tension mechanism to achieve a leveling horizontal position of the drop weight/bar. The support frame and the motor actuator may be disposed on a common platform base. The support frame may be slidably disposed on a rail affixed to an upper surface of the common platform base.

The drop weight mechanism may further include a control circuit system in electrical communication with the motor actuator and configured to operate the motor actuator. The control circuit may be in electrical communication with a DC power supply. The control circuit may include a start/stop switch configured to control an actuation of the motor actuator, and a toggle switch configured to control a direction of movement of the support frame by the motor actuator.

In yet an additional embodiment, a cross-stringing aid includes one or more assistant strings, which are pre-weaved onto cut tubes. The pre-weaved assistant strings are configured to guide cross strings through main strings so the weaving of cross strings will be in a position that is the same as the pre-weaved assistant strings. The cut tubes may be spaced apart from one another and arranged in a row. Each of the cut tubes may include a split extending from one end of the cut tube to another end of the cut tube. The split permits an insertion of the main strings both into and out of the cut tubes. Each of the cut tubes may be formed from plastic.

Each of these improvements, either alone or together, are believed to speed up the stringing process so that it is much faster than the prior art.

DRAWINGS

The above, as well as other advantages of the present disclosure, will become readily apparent to those skilled in the art from the following detailed description, particularly when considered in the light of the drawings described hereafter.

Figure 8:
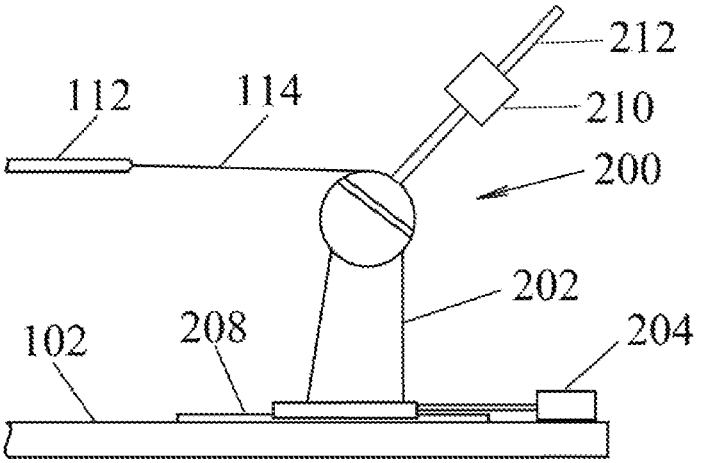
FIG. 8 is a side elevational view of a drop weight mechanism according to a first embodiment of the second improvement of the present disclosure, for use with the stringing device shown in FIG. 3.
Figure 9A:
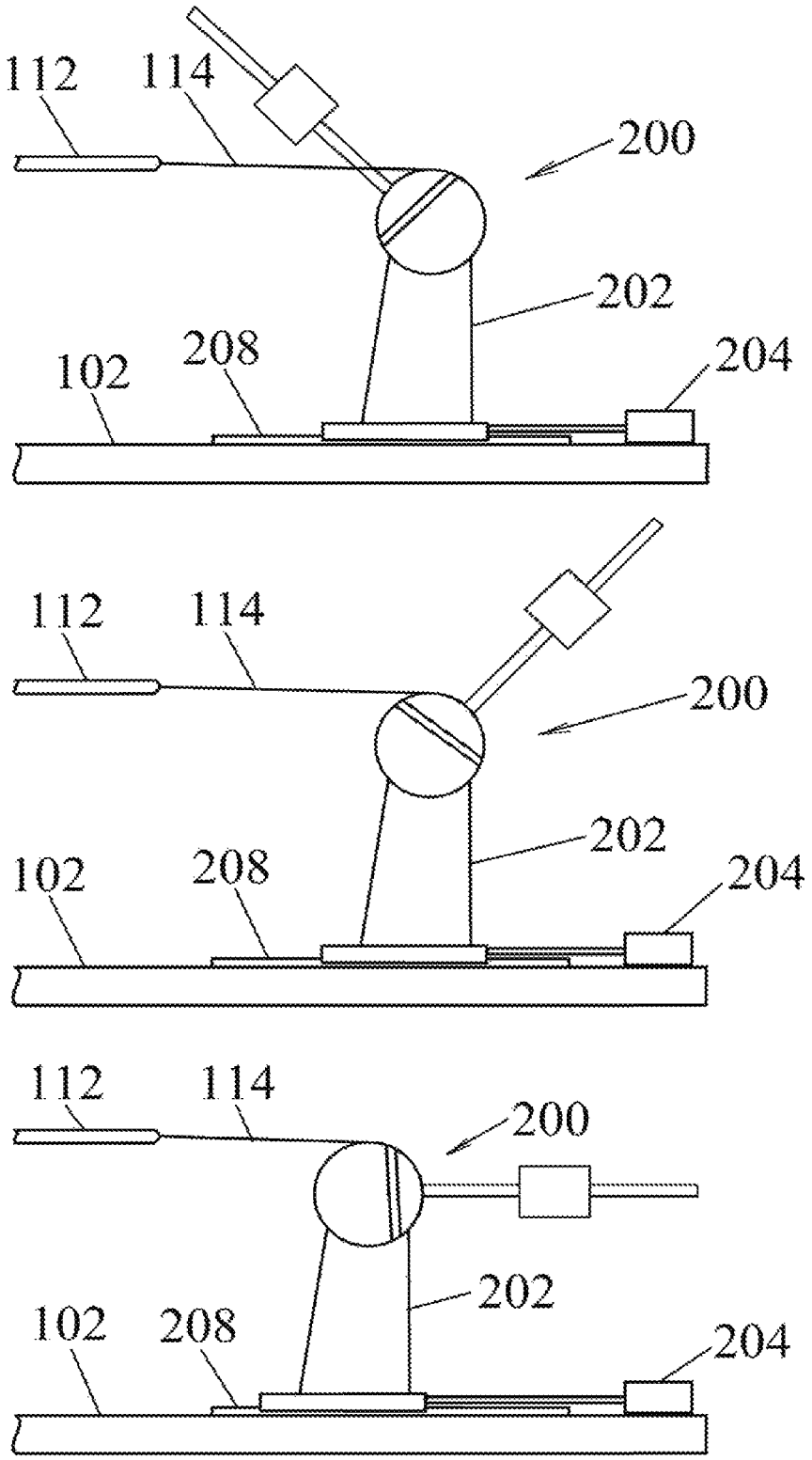
Figure 9B:
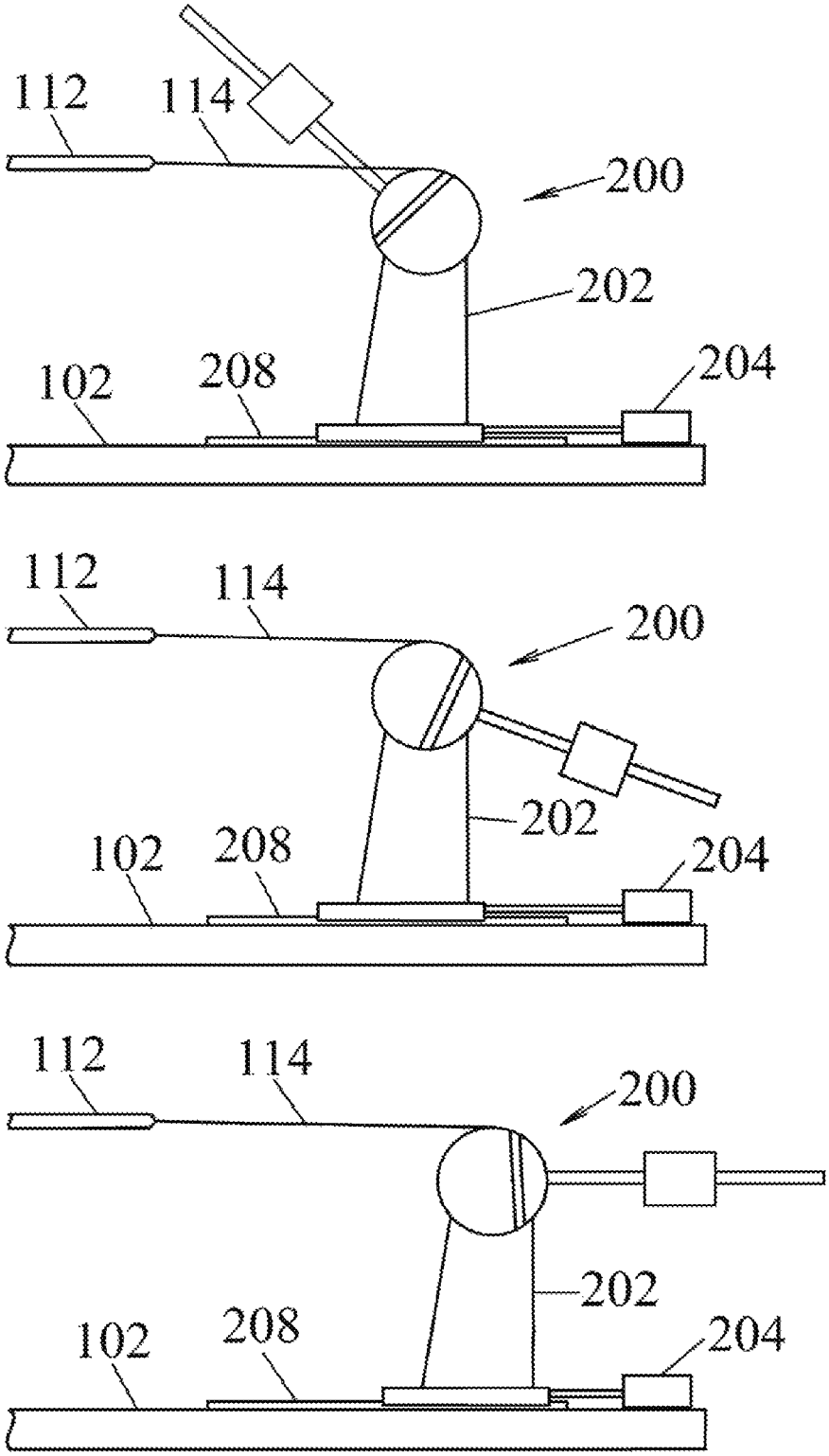
Figure 10:
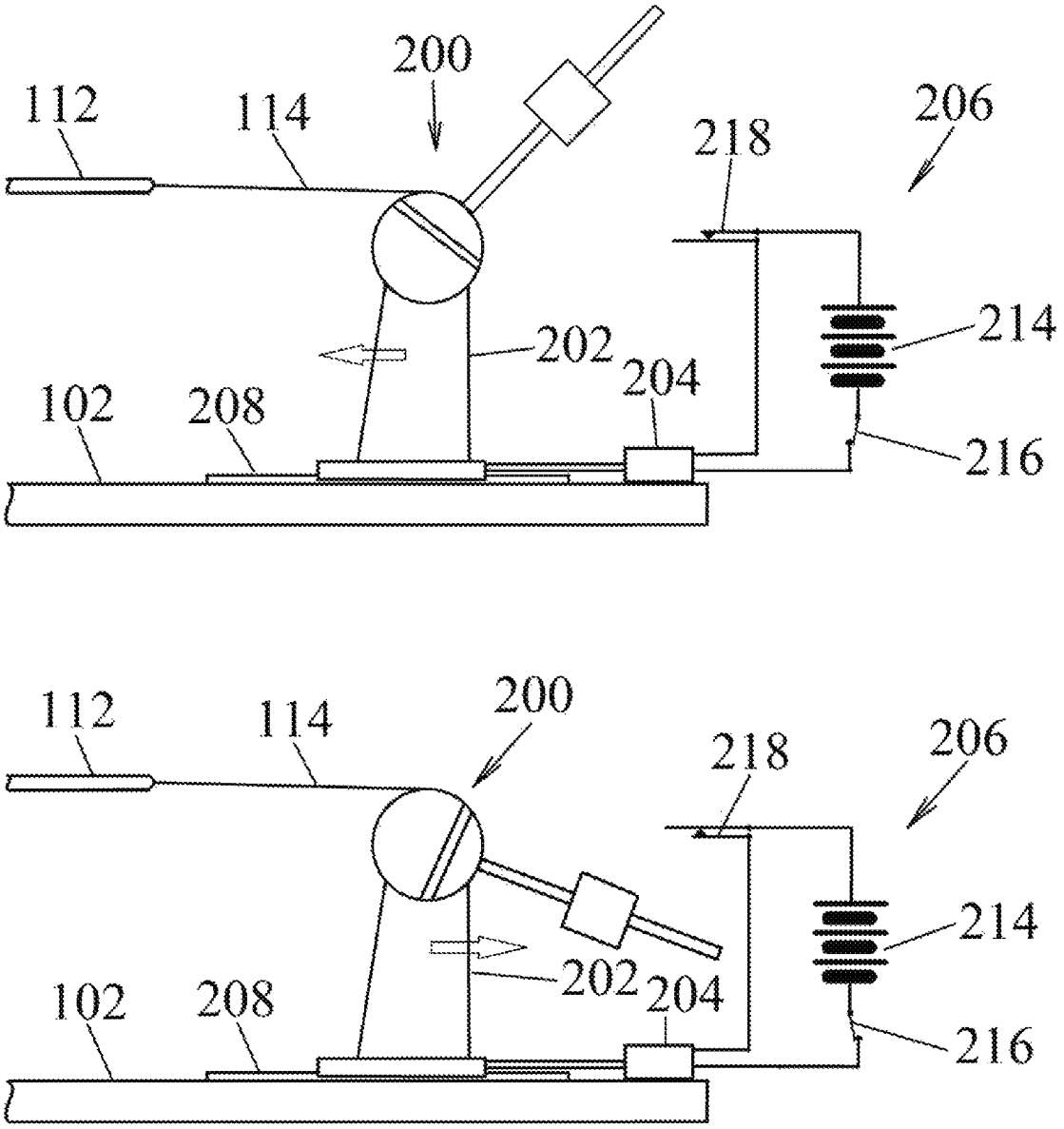
Figure 11:
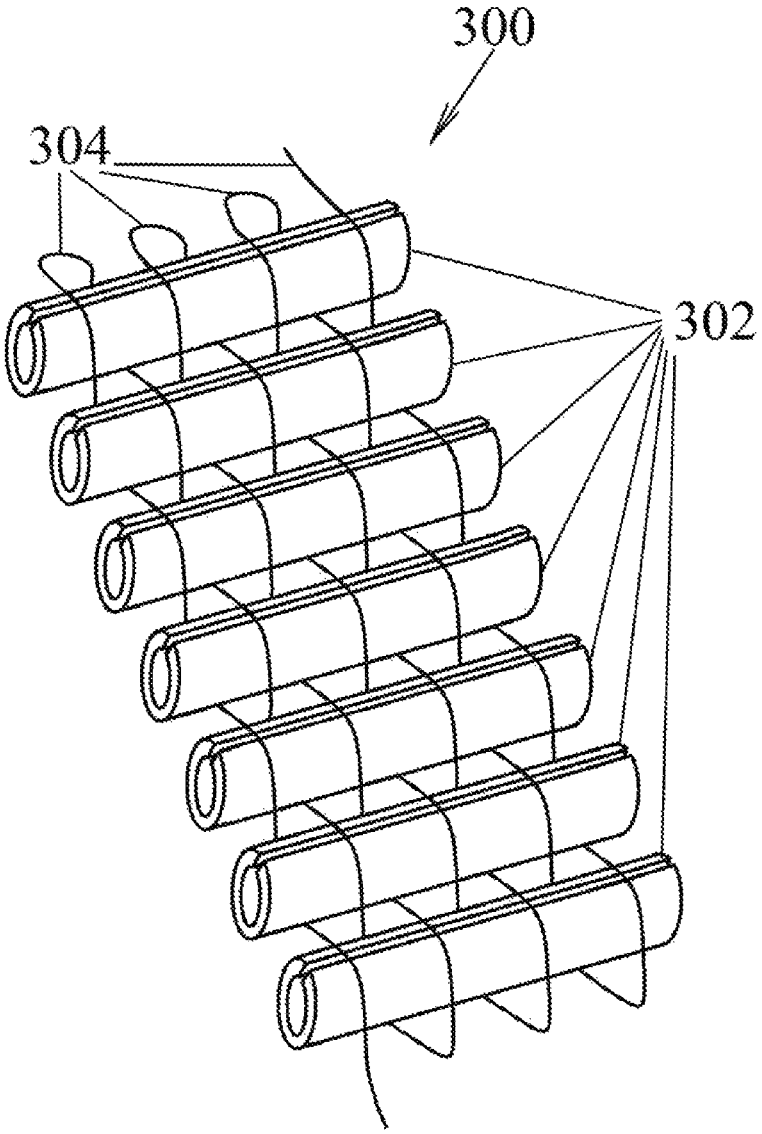
Figure 12:
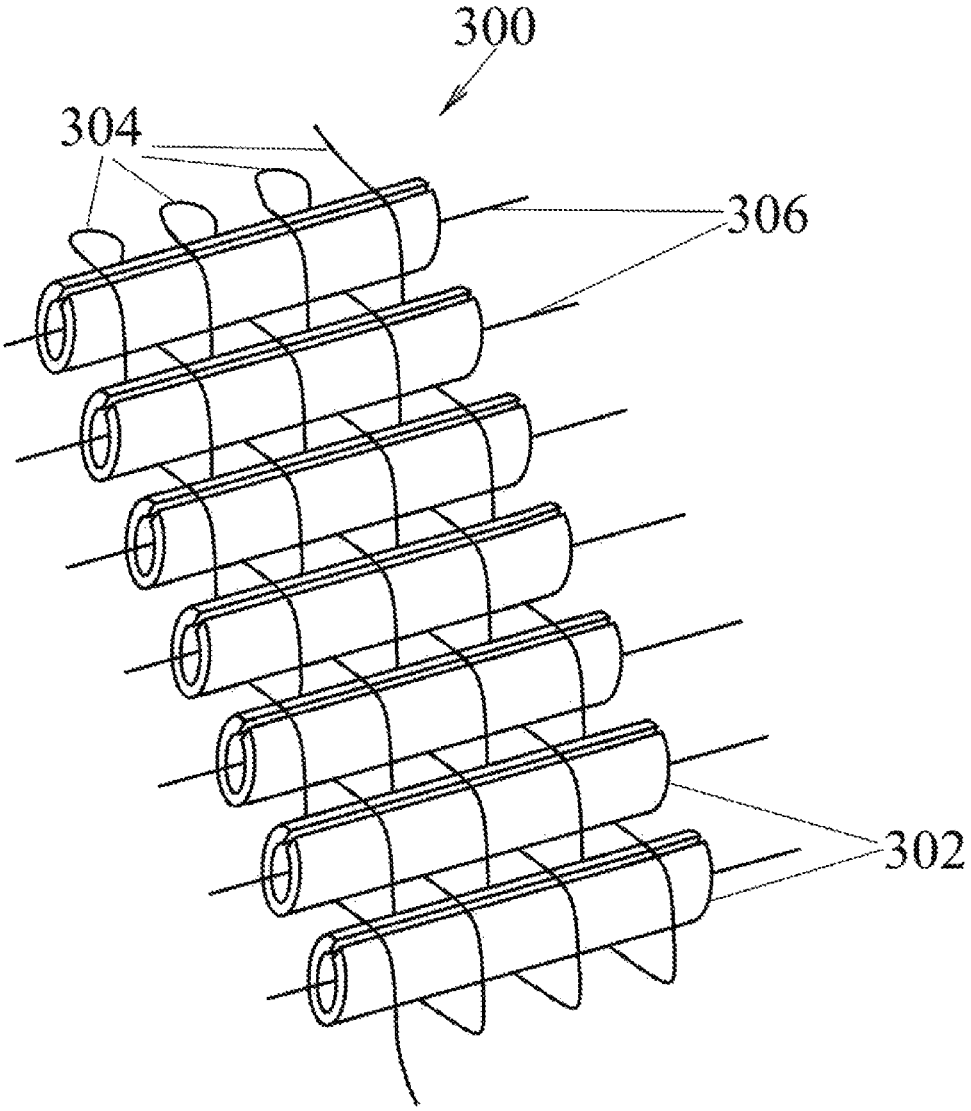
Figure 13:
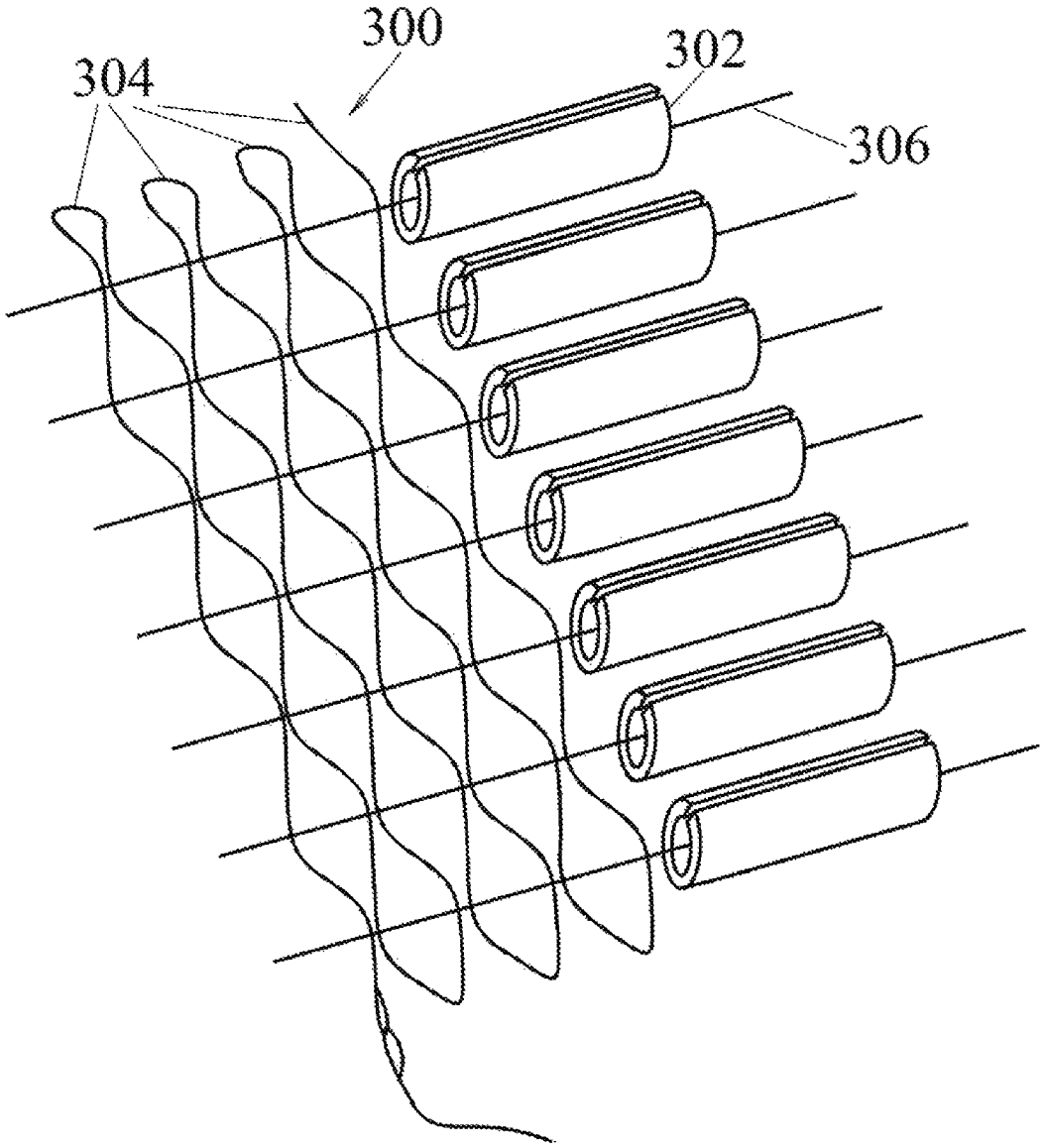
Figure 14:
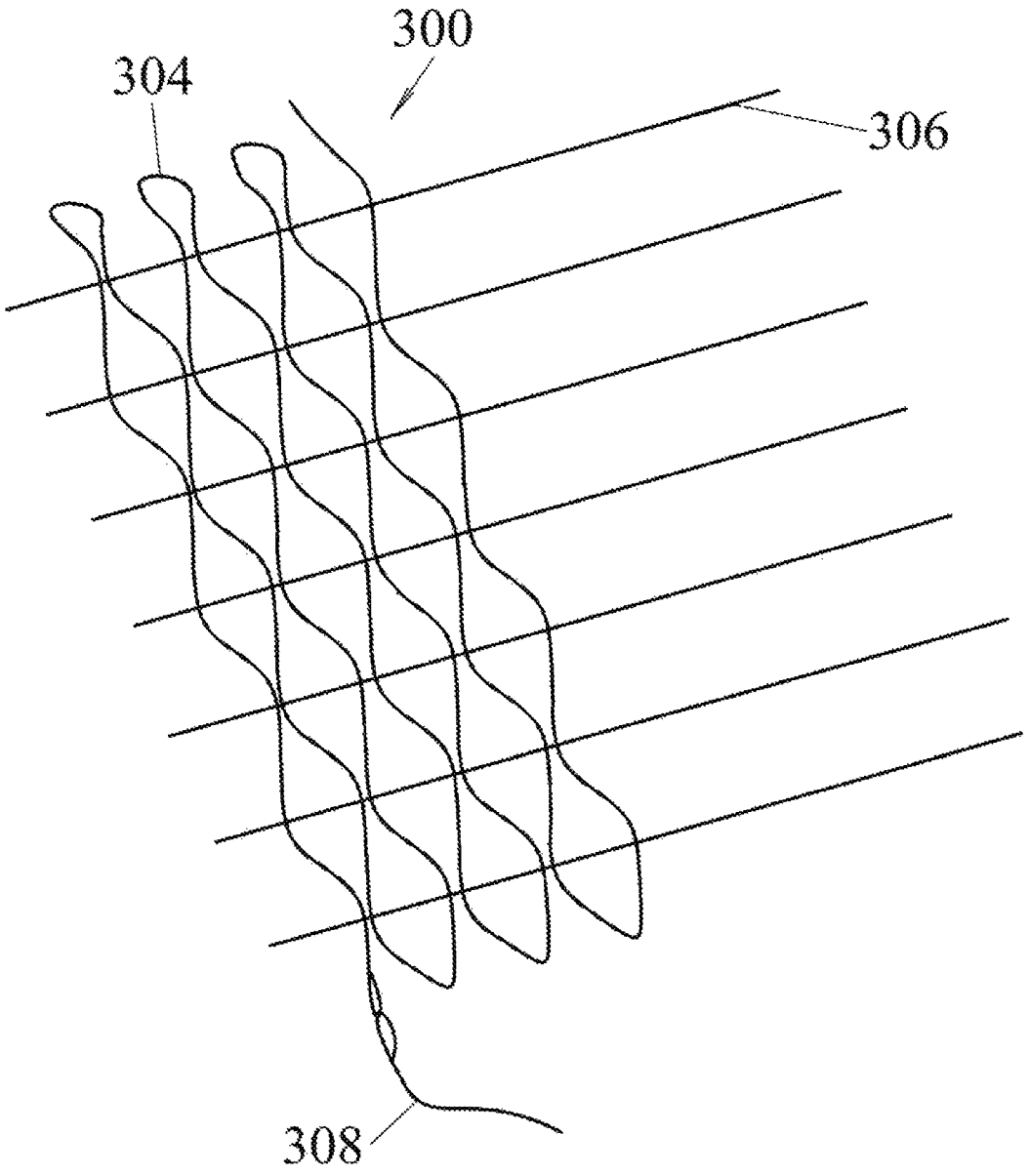
Figure 15:
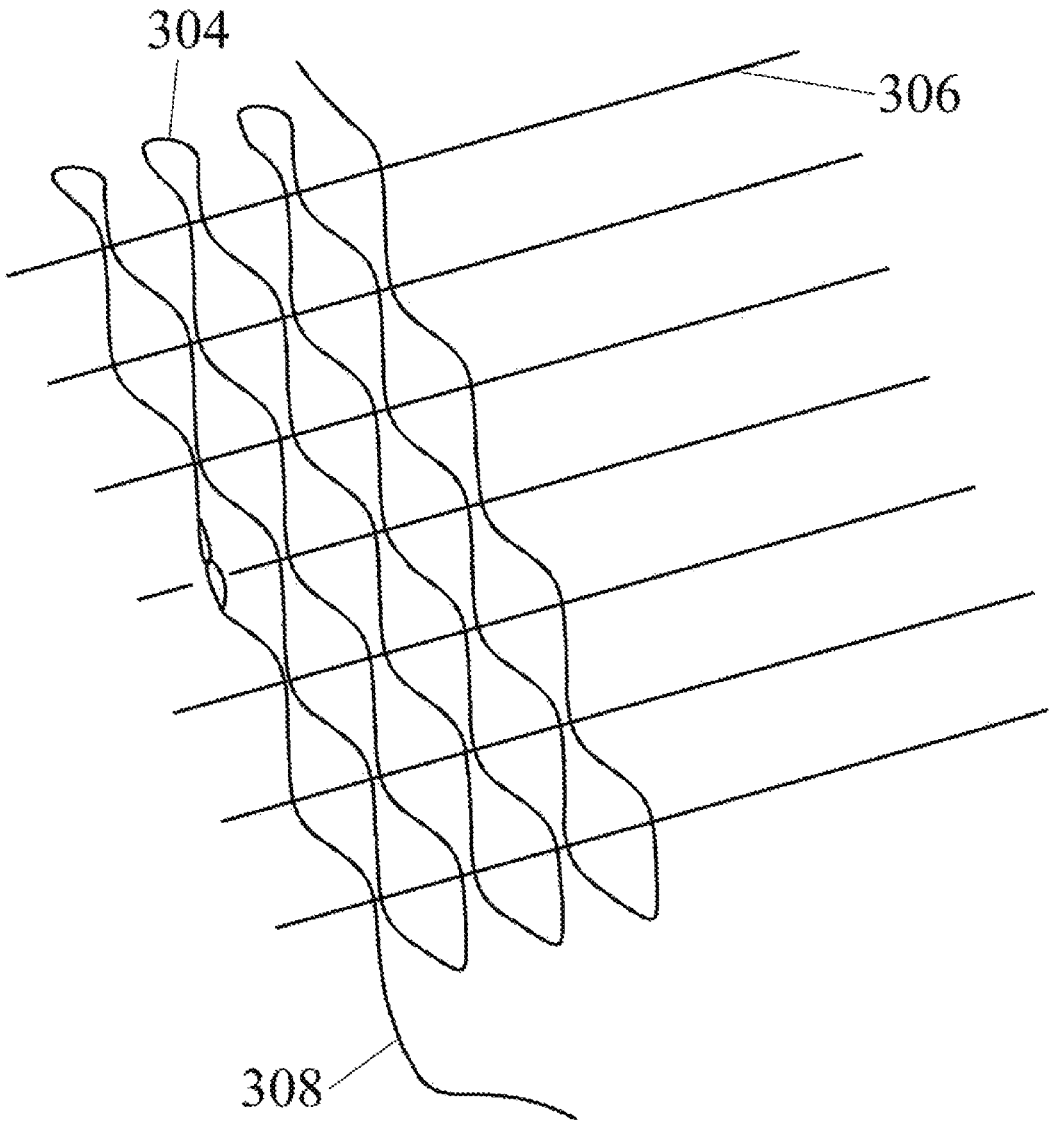
Figure 16:
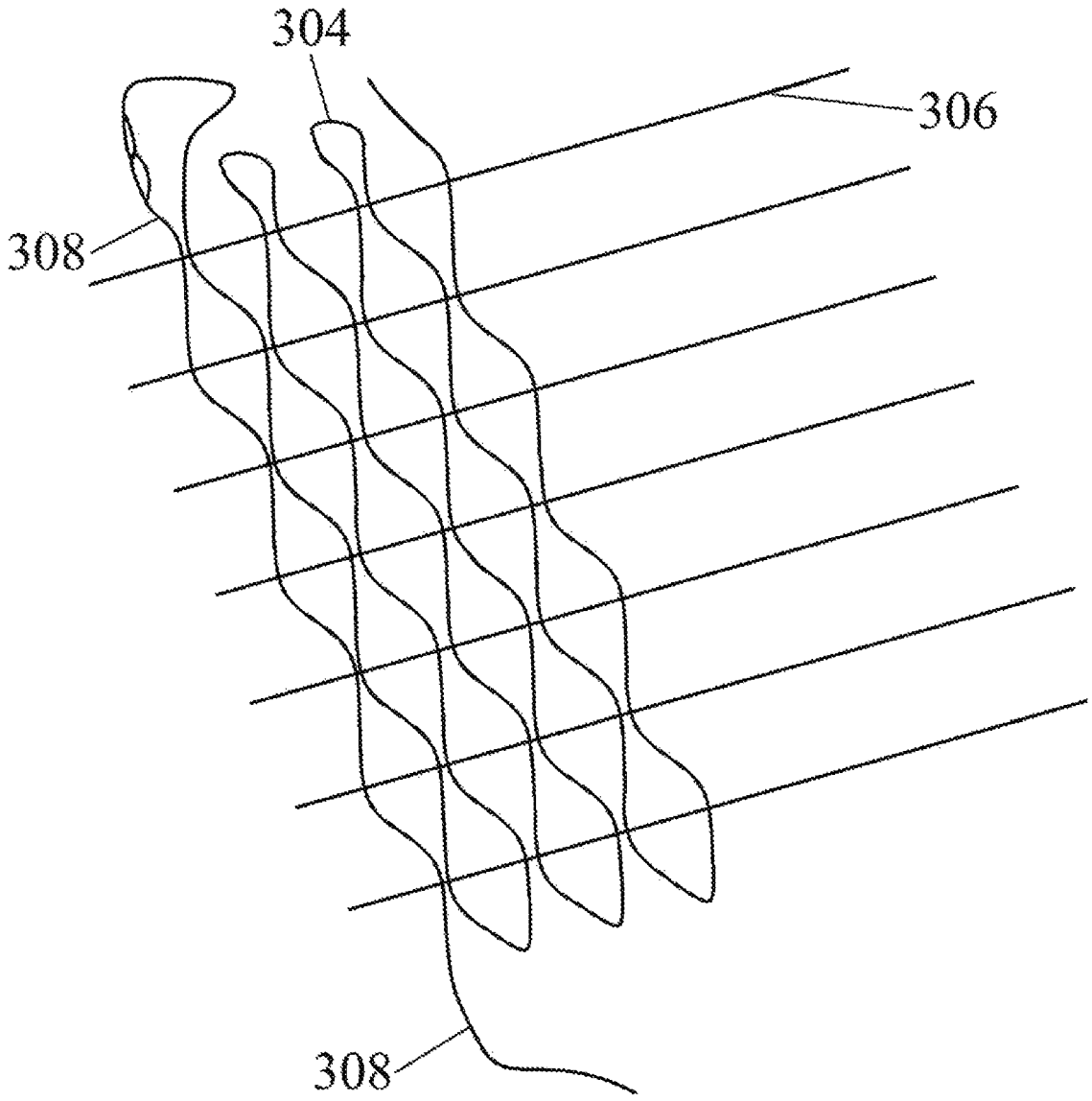

FIG. 9A includes multiple side elevational views of the drop weight mechanism illustrated in FIG. 8, shown in various stages of operation;

FIG. 9B includes additional side elevational views of the drop weight mechanism illustrated in FIG. 8, shown in various stages of operation;

FIG. 10 includes a pair of side elevational views of the drop weight mechanism illustrated in FIG. 8, and further shows a schematic of a circuit for use with drop weight mechanism;

FIG. 11 is a perspective view of a pre-weaved pattern on tubes device according to a first embodiment of the third improvement of the present disclosure;

FIG. 12 is a perspective view of the pre-weaved pattern on tubes device shown in FIG. 11, with the main strings installed through the tubes on a racket;

FIG. 13 is a perspective view of the pre-weaved pattern on tubes device shown in FIG. 11, with the main strings in position and the tubes being removing;

FIG. 14 is a perspective view of the pre-weaved pattern on tubes device shown in FIG. 11, with the tube device removed through cut slot, the main string in position, and the cross string being hooked;

FIG. 15 is a perspective view of the pre-weaved pattern on tubes device shown in FIG. 11, with the cross string pulled through the main strings; and FIG. 16 is a perspective view of the pre-weaved pattern on tubes device shown in FIG. 11, with the main strings and the cross string completed.

REFERENCE NUMBERS

The following description of reference numbers in the drawings is merely exemplary in nature and is not intended to limit the present disclosure, application, or uses.

100—Stringing machine;
102—Common platform base for stringing machine;
104—Racket mounting system;
106—First type of linkage mechanism between the common platform base and the racket mounting system;
108—Tensioning head;
110—Standing fixed clamp;
112—Racket;
114—String
116—Movable plate for the tensioning head and standing clamp;
118—Second type of linkage mechanism for the second embodiment of the first improvement;
120—Fixed support frame for drop weight tensioning mechanism;
200—Drop weight tensioning mechanism;
202—Linearly movable support frame for the drop weight tensioning mechanism;
204—Motor actuator;
206—Control circuit system for the actuator;
208—Rail for the linearly movable support frame of the drop weight tensioning mechanism;
210—Drop weight for the drop weight tensioning mechanism;
212—Drop weight bar;
214—DC power supply;
216—Toggle switch;
218—Stop switch for the drop weight bar;
300—Pre-weaved pattern;
302—Cut pipes or tubes;
304—Assistant strings;
306—Main string; and
308—Cross strings.

DETAILED DESCRIPTION

The following description is merely exemplary in nature and is not intended to limit the present disclosure, application, or uses. It should also be understood that throughout the drawings, corresponding reference numerals indicate like or corresponding parts and features. In respect of the methods disclosed, the order of the steps presented is exemplary in nature, and thus, is not necessary or critical unless otherwise disclosed.

Section 1: The First Improvements of the Present Disclosure—Tensioning the Two Strings in the Opposite Direction Simultaneously:

For the first improvement, referring to the exemplary embodiments of the present disclosure as disclosed in the drawing at FIGS. 3-6, the basic components of stringing machine 100 of the present disclosure includes a common platform base 102, a movable racket mounting system 104, a linkage mechanism 106 between the racket mounting system 104 and the common platform base 102, a tensioning head 108 and a standing fixed clamp 110.

The common platform base 102 is the base for the stringing machine 100. All the other components will be either installed on it at fixed location or situated on it. The racket mounting system 104 will be on the top of the common platform base 102 and in its center. Under the racket mounting system 104, there are several rolling balls or wheels, which make the racket mounting system 104 movable on the common platform base 102. The linkage mechanism 106 will be used to limit the movement of the racket mounting system 104 in only in certain rotation and linear direction. The tensioning head 108 will be fixed on one end and the standing fixed clamp 110 will be in the other end on the common platform base 102 across its center.

The operation of the stringing machine 100 of the present disclosure is described as following, referring to the FIGS. 3-6. After a string 114 is threaded through a grommet holes on the racket 112, and out of the racket 112, the string 114 will be clamped on the standing fixed clamp 110, and the other end of the string 114 will be threaded through the opposite grommet hole of the racket, then installed on the tensioning head 108 with the string grip.

Figure 1:
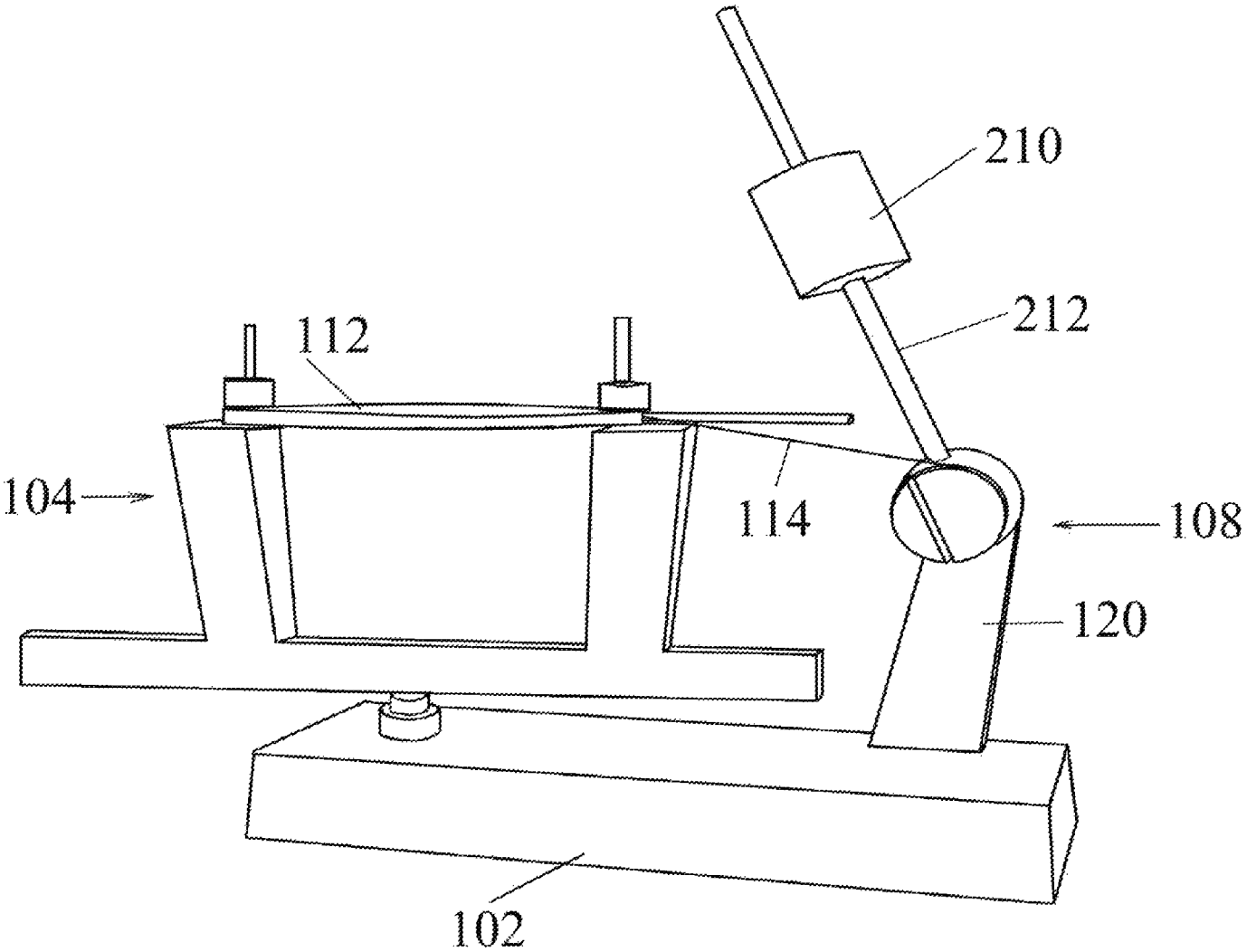
FIG. 1 (Prior Art)
FIG. 1 is side elevational view of a manual stringing device of the prior art, for use in stringing a racket.
Figure 2:
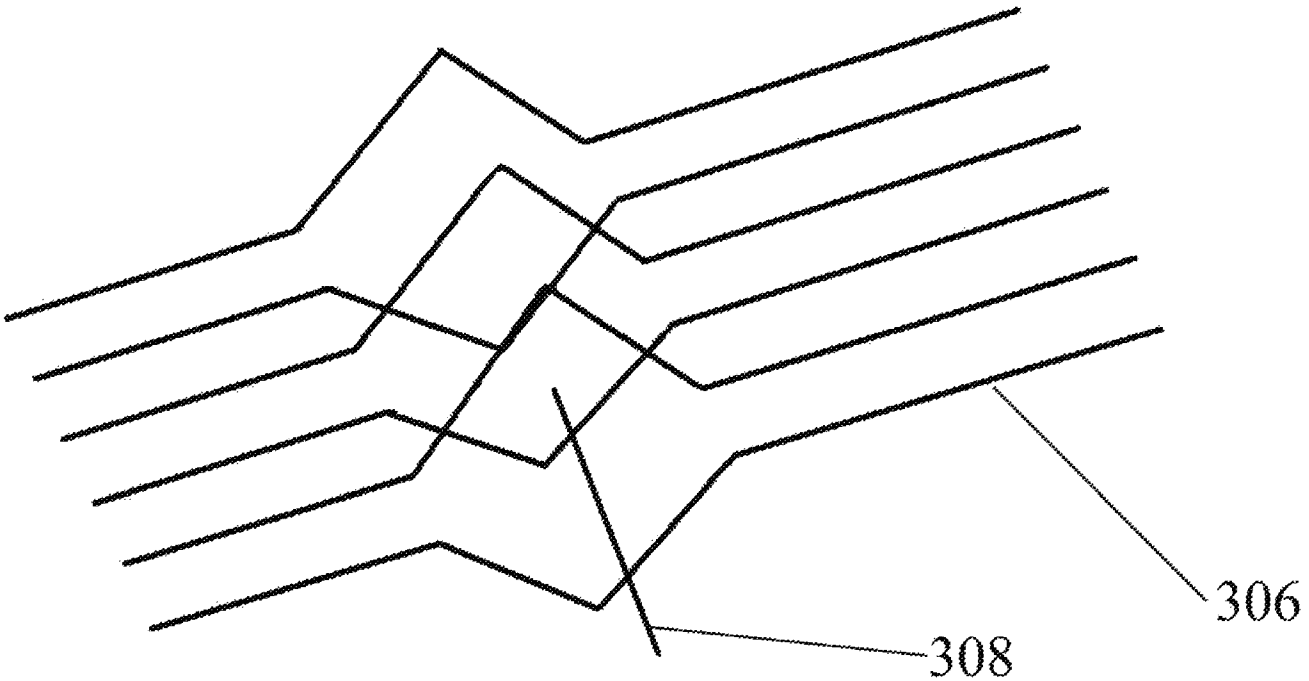
FIG. 2 (Prior Art)
FIG. 2 is a schematic diagram illustrating a cross-stringing method of the prior art for assistant of cross string installation.
Figure 3:
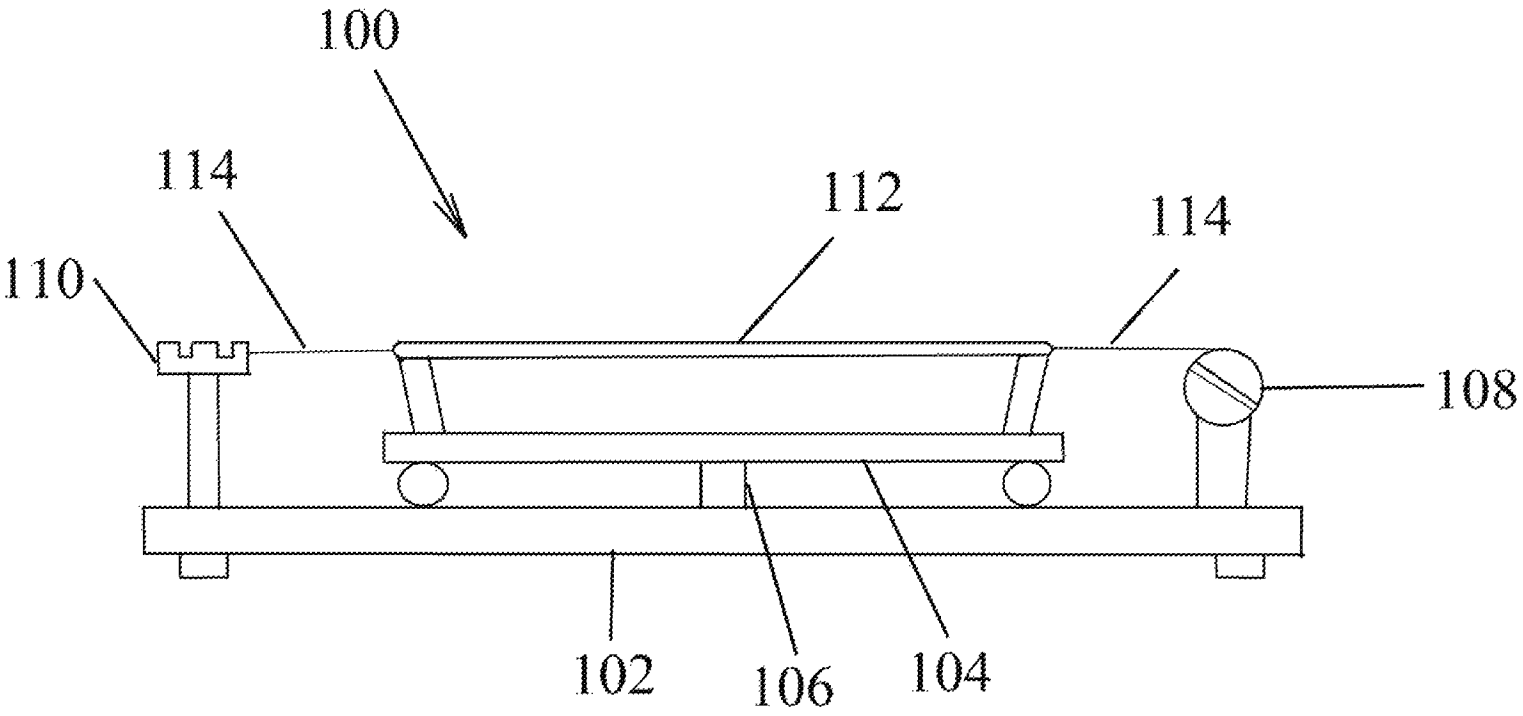
FIG. 3 is a side elevational view of a stringing device according to a first embodiment of the first improvement of the present disclosure, for use in stringing a racket.
Figure 4:
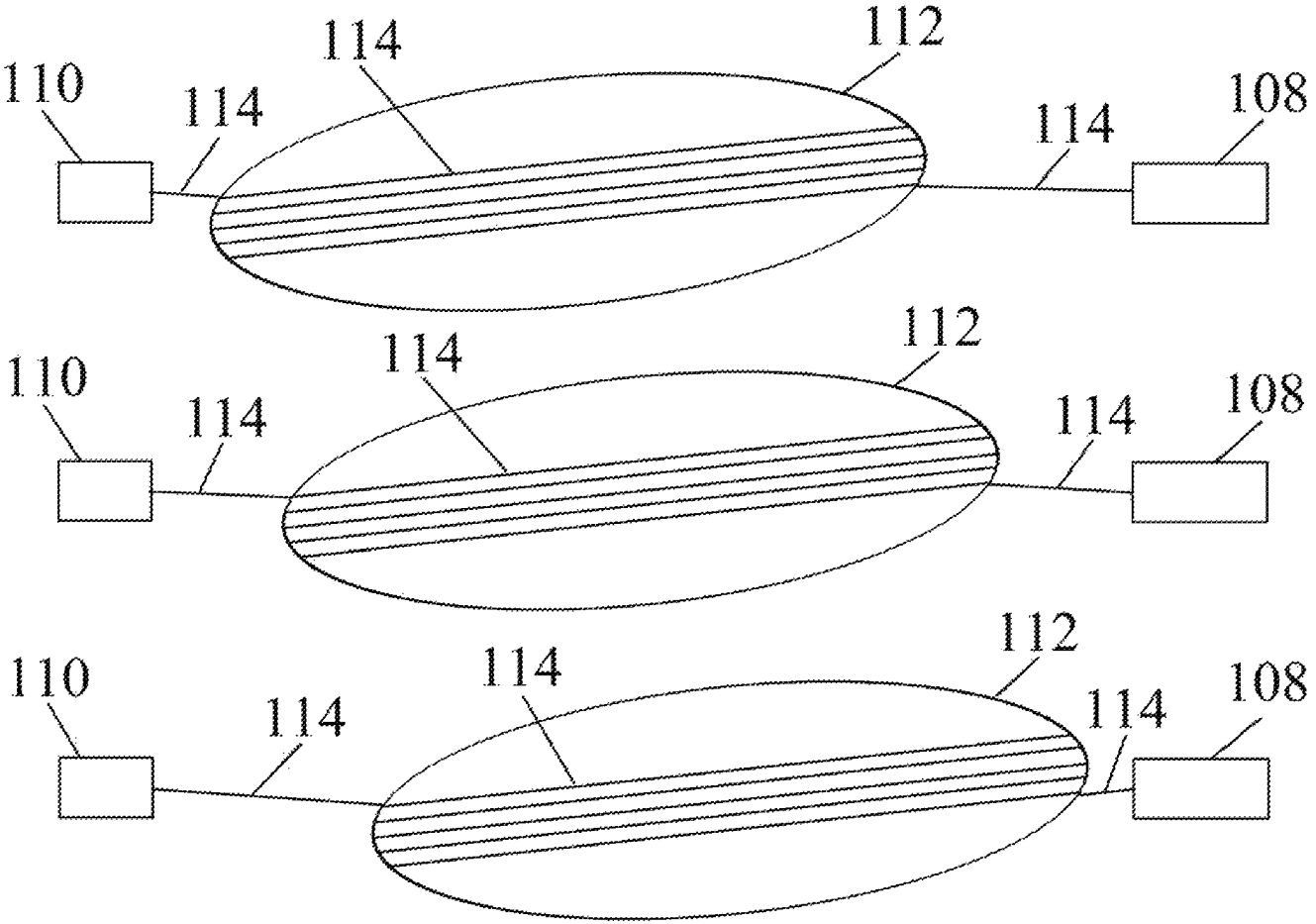
FIG. 4 is a diagram illustrating a stepwise process for stringing of the racket using the stringing device shown in FIG. 3.

This process is shown in FIG. 4 with a starting position (top), an intermediate position (middle), and a final position (bottom). When it is ready, as shown in the top starting position of FIG. 4, the tensioning head 108 will apply tension on the string 114 on the tensioning head 108 side by pulling the string 114. Since the racket mounting system 104 is movable, this tensioning force will pull the racket 112 together with the racket mounting system 104 moving toward to the tensioning head 108. This movement of the racket mounting system 104 will pull the string 114 between the racket 112 and the standing fixed clamp 110 and cause the tension of the string 114 to increase. As shown in the middle intermediate position, the string 114 between the racket 112 and the tensioning head 108 (right side) is shortened, and the string 114 between the standing fixed clamp 110 and the racket 112 (left side) is elongated. The final static balanced position, shown in the bottom final position in FIG. 4, will be reached when the desired string tension between the tensioning head 108 and the racket 112 is achieved. At this final position, the string 114 between the racket 112 and the tensioning head 108 will be even shorter with the desired tension, and the string 114 between the standing fixed clamp 110 and the racket 112 will be getting further longer with tension that is very close to the desired tension. The string tension between the racket 112 and the stranding fixed clamp 110 should be very close to the desired tension by the tensioning head 108. The difference is the friction force between the racket mounting system 104 and the common platform base 102, which could be reduced by good design of the moving mechanism of the racket mounting system 104. At this point, the string tension on the racket 112 could be held by the clamps, de-grip the strings from the string tension mechanism and the standing fixed clamp 110, rotate the racket mounting system 104 a small angle to face to the next string, and continue to another pair strings.

There are several advantages of the present disclosure over the prior art. The first is to tension the two opposite strings with one action of the tensioning head 108. This will save time over doing it one by one. The second is the racket mounting system 104 does not need to be rotated 180 degrees for every string. It only needs to rotate a small angle for next pair of strings. The maximum rotation angle may be about 45 degrees only. The third is due to the nature of doing each type action (i.e., string grip, threading string through grommet holes, and clamping string to holding tension) by pairs, this will save time for stringer.

Figure 5:
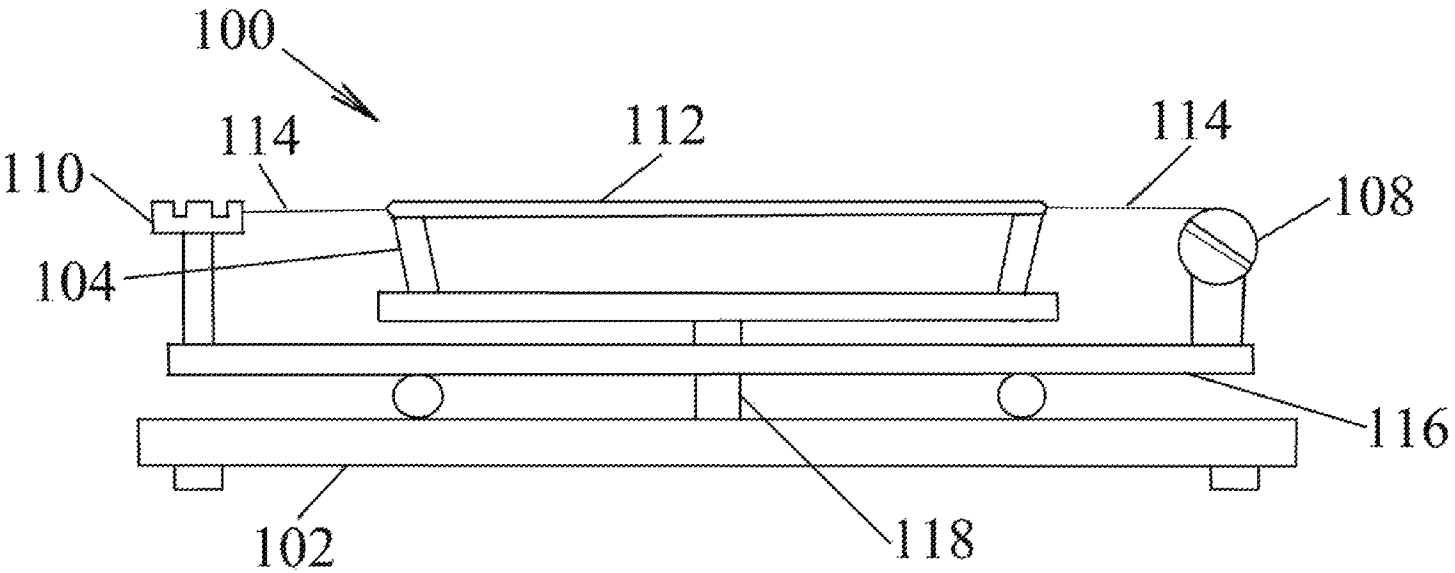
FIG. 5 is a side elevational view of a stringing device according to a second embodiment of the first improvement of the present disclosure, for use in stringing a racket.

The second embodiment of the first improvement is shown in FIG. 5. Here the racket mounting system 104 is only rotatable on the common platform base of stringing machine 102. A movable plate 116 is used to hold the standing fixed clamp 110 and the tensioning head 108. The movable plate 116 is movable along one direction linearly relative to the racket mounting system 104 and the common platform base 102. The same result is achieved as the first embodiment as described hereinabove.

Figure 6:
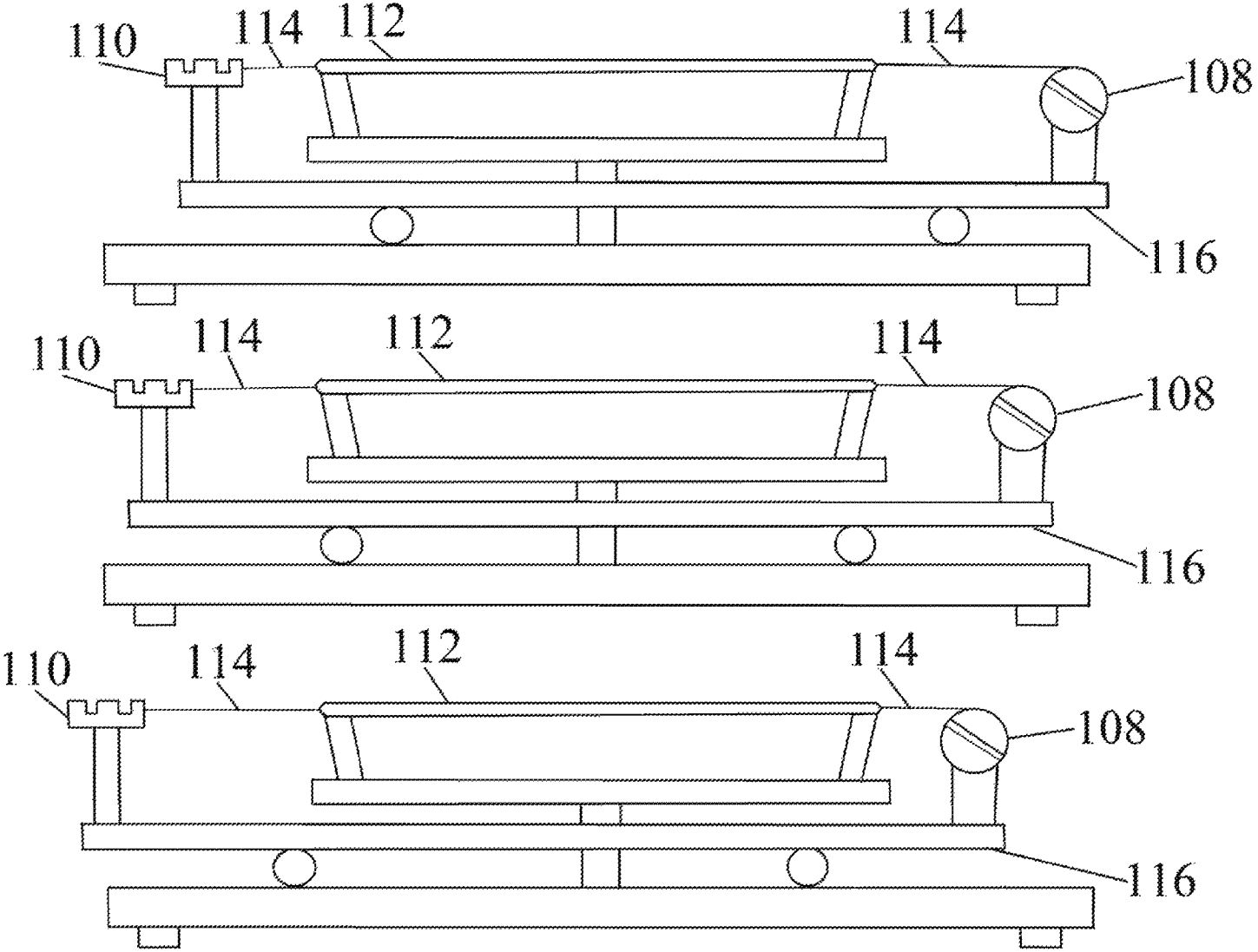
FIG. 6 is a diagram illustrating a stepwise process for stringing of the racket using the stringing device shown in FIG. 5.
Figure 7:
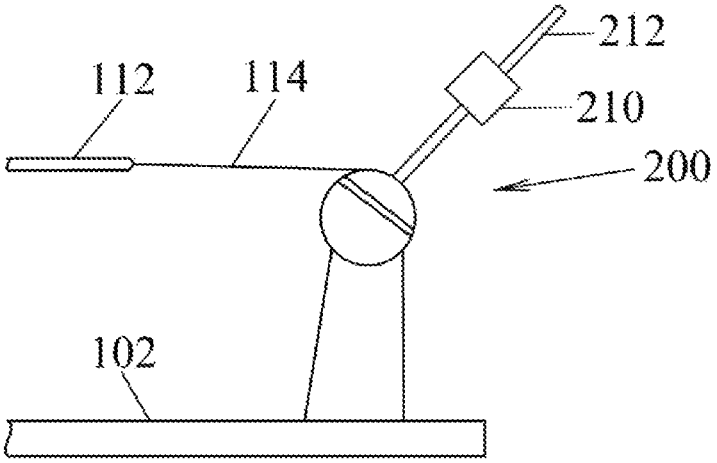
FIG. 7 (Prior Art)
FIG. 7 is a side elevational view of a drop weight mechanism of the prior art, for use with the stringing device shown in FIG. 1.

The stringing process for the second embodiment is shown in FIG. 6, with a starting position (top), an intermediate position (middle), and a final position (bottom). When stringing, the movable plate 116 moves to achieve the tension the both strings 114 at the same time. But the racket 112 and the racket mounting system 104 stands still at its position. The result of this embodiment is same as the first embodiment—tensioning two strings by one action of tensioning head 108.

The main purpose of the movable racket mounting system 104 of first embodiment or the movable plate 116 base for the string tensioning mechanism of the second embodiment is to transfer the tensioning force from the side of the string tensioning mechanism to the opposite side of the racket 112. This is different to the prior art, in which the tensioning force from the tensioning head is against the fixed racket or racket mounting system. So, it can only tension one string at a time. Any other design considerations are possible only if it can transfer the tensioning force from one side of racket to the other side of the racket when it is on the racket mounting mechanism. It could be a hard linkage on any location (side of the racket mounting mechanism, top of the racket mounting mechanism, and/or even linkage by soft link method).

Section 2: The Second Improvements of the Present Disclosure—Linearly Moveable Support Frame for the Drop Weight:

For the second improvements, referring to the exemplary embodiment of the present disclosure as disclosed in FIGS. 8-10, the stringing machine of the present disclosure includes a common platform base 102, a racket mounting system 104, a drop weight mechanism 200, a linearly movable support frame 202 for the drop weight, a motor actuator 204, and a control circuit system 206 for the motor.

For this improvement, the common platform base and the racket mounting system 104 is same as the prior art. The racket mounting system 104 is at the fixed location on the common platform base 102. The main changes are the linearly movable support frame 202 for the drop weight mechanism 200, compared to the fixed support frame for the drop weight mechanism in the prior art. The motion of the movable support frame 202 could be controlled by any mechanical mechanism along the direction of moving toward to or away from the racket mounting system. But in this embodiment, the electric motor actuator 204 is used to achieve the best result for the design.

The operation of the stringing machine with this improvement of the present disclosure is described as following, referring to the FIGS. 9-10. The stringing process in both FIG. 9*a* and FIG. 9*b* is shown in three positions: the starting position at the top; the intermediate position at middle; and the final position at bottom. After the string is threaded through grommet hole and installed on the pulley of the drop weight and gripped, as shown at the top starting position in both FIG. 9*a* and FIG. 9*b*, the drop weight bar will be manually rotated away from the racket mounting system 104. When it is free, depending on the string length between the racket mounting system 104 and the drop weight, the drop weight bar will be stopped at either above the horizontal position (middle intermediate position in FIG. 9*a*) or below the horizontal position (middle intermediate position in FIG. 9*b*) at the balanced point between the drop weight and the tension of the string 114. If it is above the horizontal position (middle in FIG. 9*a*), the toggle switch 216 for the electric motor actuator 204 will be toggled to move the support frame 202 of the drop weight 200 toward to the racket mounting system 104. This movement of the support frame 202 of the drop weight 200 makes the drop weight gradually come down to the level position (bottom in FIG. 9*a*). If it is below the horizontal position (middle in FIG. 9*b*), the toggle switch 216 for the electric motor actuator 204 will be toggled to move the support frame 202 of the drop weight 200 away from the racket mounting system 104. Similar as above, but in the other direction, this movement of the support frame 202 of the drop weight 200 makes the drop weight gradually move up to the level position (bottom in FIG. 9*b*). In both cases, the electric motor actuator 204 will be stopped when the drop weight bar reaches to horizontal position. The desired tension on the string 114 should be achieved at this point.

The circuit schematic of the current embodiment showing in the FIG. 10 is most basic controlling circuit design. The two drawings in FIG. 10 correspondence to the two starting positions: the drop weight at above the level position (top); and the drop weight at the below the level position (bottom). When the drop weight is at the above starting position (top), the toggle switch 216 will be toggled to the left so the motor will move the support frame 202 to the left direction and the drop weight will be come down gradually. When the drop weight/bar reaches the level position, the stop switch 218 will be touched, opening the circuit, and the motor will be stopped so the desired tension on string 114 is achieved. The operation for the drop weight below the level position (bottom) is similar, but in the opposite direction. In both cases, the drop weight will be at the level position at the final position and the string will be tensioned to the desired tension. Additional electronic components could be added to achieve a fully automatic one-touch operation of the tensioning process.

The main advantage of this improvement to the drop weight tensioning method is to make the drop weight tensioning method easier to operate. So, the convenience of the advanced stringing machine could be achieved with a much lower cost. The other advantage is the constant pulling, especially compared to the instant pulling by the mechanical crank tensioning method.

The other embodiment to move the support frame of the drop weight is to use a manual handle to manually rotate a thread and screw system with gears. It is simpler than the electric motor actuator with lower cost.

The main principle for the drop weight tensioning method to work is to achieve three conditions simultaneously: the desired string tension, the drop weight bar at the horizontal position, and a certain string length between the racket and the drop weight pulley. All the prior art for the drop weight method is designed with a fixed distance between racket mounting system and the drop weight tensioning head. So, the length of string between the racket to the gripper must be adjusted by the manually re-adjust method or the clutch method to achieve the above three conditions simultaneously. The main difference of the present disclosure over the prior art is to have the drop weight system movable to achieve the above three conditions. The present disclosure has the distance between the racket mounting system and the drop weight system variable, instead the of fixed as in the prior art. The above embodiment of moving the support frame of the drop weight linearly is just one method to achieve this design principle. Other embodiments are possible In another embodiment, not shown, the support frame could be rotated around its base so the drop weight head will move toward to or away from racket mounting system. So, the same result as the above embodiment is achieved. In fact, according to the principle in the above paragraph, any method to change the distance between the racket/racket mounting system and drop weight tensioning head is feasible to get the same result mentioned above.

Section 3: The Third Improvement of the Present Disclosure—Cross-stringing Aid:

The third improvement of the present disclosure is for weaving the cross string. It will use the pre-weaved pattern of the assistant strings to help the weaving of the cross strings.

Referring to FIGS. 11-16, the first embodiment of the third improvement of the present disclosure, involving the pre-weaved pattern 300 of the assistant strings, is shown. The assistant strings 304 are pre-weaved onto many cut pipes or tubes 302, which are used to hold the pre-weaved pattern 300 of the assistant strings 304. Each one of these pipes has an opening slot along its side. These opening slot (cut) are designed to be used when removing these pipes from main strings by slipping the main string through opening slot (cut). The pre-weaved pattern 300 of the assistant strings 304 goes under one pipe and then goes above the next pipe in the sinuous pattern until all the pipes are used. Then, the next assistant string goes to the same sinuous pattern, but in the opposite side of the pipe of the one before, or inverse phase like the sinuous wave. Then all of subsequent assistant strings 304 will follow same fashion to be pre-weaved on the pipes 302, as shown in FIG. 11.

The number of the pipes 302 will equal the number of the main strings 306 of the racket, which is depending on the racket types, usually 16 or 18 for tennis racket and 22 for badminton racket. The number of the assistant strings 304 also depends on the type of racquet, and will be equal to the number of cross strings 308 of racket. For example, for most badminton racquets, the number of the assistant strings is 21 and for common tennis racquets, it is 18. The assistant string 304 could be just one string and this one assistant string 304 just goes back and forth a certain number of times in the pre-weaved pattern on to the pipes. Or there are multiple assistant strings 304 where each one only thread through the pipes/tubes 302 once.

The pipes 302 used in the above embodiment are just like straws with an opening slot on its side, in the direction of pipe. The pipe 302 could be in a shape of other than being round. The size of the pipes 302 should be long enough to hold all the assistant strings 304, enough inside diameter to let the main string 306 to get through it, and small enough to fit into the spacing between the main strings. The material of the pipes 302 could be plastic or any others; however, plastic may be preferred due to cost and flexibility.

The assistant strings 304 could be made in any materials. It should be flexible and small enough to get around the pipes 302. It could have hook or loop at its end so it would be easy to hoop or tie to the cross strings 308. The assistant string 304 could be one piece of string going back and forth on pipes 302 with adjunction one alternate up and down on the pipes. Also, the assistant strings 304 may be multiple piece short strings, each one of them just goes once with weaved pattern on the pipes 302.

The operation or usage of the pre-weaved pattern 300 to help weaving the cross string 308 is in following. Referring FIGS. 11-16, when installing the main strings 306 on to the racket 112, after a main string is threaded through a grommet hole of the racket from outside of the racket 112 to inside of the racket 112, this main string will be threaded through of one end of a pipe of the pre-weaved pattern in the proper position and come out from another end of the same pipe, and then to the other grommet hole on the other side of the racket 112 from inside of the racket 112 to the outside of the racket 112. The position of this pipe should be same as the position of this main string on racket 112. Then the next main string will be installed in the same way. After all the main strings are threaded and installed on the racket 112, the pre-weaved pattern 300 of the assistant strings 304 with the pipes 302 should be on the racket 112 as show in FIG. 12.

The next step is to remove the pipes 302 from the main strings 306 so the pre-weaved pattern 300 of the assistant strings 304 themselves will be on the racket 112. This can be done by sliding the pipes 302 on the main strings 306 along the longitude direction and keep the assistant strings 304 static on its original position, as shown in FIG. 13. After the pipes 302 are off the assistant strings 304, it can be taken off the main strings 306 by slipping through the slot opening along the pipes 302, not shown. The pre-weaved pattern 300 of the assistant strings 304 is then on the racket 112 with main strings 306 in position, either tensioned or not tensioned.

Referring to FIGS. 14-16, when installing the cross strings 308, the assistant strings 304 with the pre-weaved pattern on the main strings 306 are used to help weaving the cross strings 308 through the main strings 306. After a cross string 308 is threaded through a grommet hole of one side of racket from outside of racket into the inside of the racket, this cross string 308 will be tied together with a free end of the assistant string 304 on the same side of the racket, as shown in FIG. 14. Then the other end of the assistant string 304 on the other side of racket will be pulled. During this pulling action of the assistant string 304, the assistant string 304 will come out of the weaving pattern of the main strings 306 on the racket and the cross string 308 will get pulled into the weaving pattern of the main strings 306 on the racket, as shown in FIG. 15. So, the weaving pattern of the assistant string 304 is now transferred to the cross string 308 tied together in the early step, as shown in FIG. 16. Then, the cross string 308 should be threaded through the grommet hole on racket from inside of the racket to the outside of the racket 112 and continuing to next one. This same process will be repeated for all the cross strings 308. When all the assistant strings 304 are pulled out of the main strings 306, the whole weaving pattern of the assistant strings 304 are transferred to the cross strings 308.

The above process of transferring the pre-weaved pattern 300 of the assistant strings 304 to cross strings 308 could be done either before or after tensioning the main strings 306. It is preferred to be done before the tensioning of the main strings 306. If the main strings 306 are not tensioned when installing the cross strings 308, there is not much pressure between the main strings 306 and cross strings 308. So, the heat burning of the main strings 306 could be avoided. In another word, the special caution to move the cross string 308 around the man strings 306 is not necessary when pulling the cross strings 308. This also can save some time for the stringer.

It should be appreciated that the above-mentioned first, second, and third improvements and their various embodiments may be employed individually, or in combinations with each other or with conventional racket stringing systems, and that all such individual uses and combinations are contemplated by the present disclosure.

While certain representative embodiments and details have been shown for purposes of illustrating the invention, it will be apparent to those skilled in the art that various changes may be made without departing from the scope of the disclosure, which is further described in the following appended claims.

What is claimed is:

1. A stringing apparatus for a racket, comprising:
- a common platform base;
- a movable racket mounting system disposed on the common platform base;
- a linkage mechanism disposed between the racket mounting system and the common platform base;
- a tensioning head disposed on one side of the movable racket mounting system; and
- a standing fixed clamp disposed on another side of the movable racket mounting system, wherein the movable racket mounting system is a movable or float mechanism configured to transfer a tension force from one side of a racket to another side of a racket, wherein the movable racket mounting system is configured to pull a racket disposed on the racket mounting system toward the tensioning head and pull a string disposed between the racket and the standing clamp to cause an increased tensioning of the string.

2. A stringing apparatus for a racket, comprising:
- a common platform base;
- a movable racket mounting system disposed on the common platform base;
- a linkage mechanism disposed between the racket mounting system and the common platform base;
- a tensioning head disposed on one side of the movable racket mounting system; and
- a standing fixed clamp disposed on another side of the movable racket mounting system, wherein the movable racket mounting system includes a plurality of rolling balls or wheels.

3. A stringing apparatus for a racket, comprising:
- a common platform base;
- a movable racket mounting system disposed on the common platform base;
- a linkage mechanism disposed between the racket mounting system and the common platform base;
- a tensioning head disposed on one side of the movable racket mounting system; and
- a standing fixed clamp disposed on another side of the movable racket mounting system, wherein the standing fixed clamp is disposed on the common platform base and configured to secure a string of a racket on a side of the movable racket mounting adjacent the standing fixed clamp, and the tensioning head is disposed on the common platform base and configured to hold the string of the racket on a side of the movable racket mounting system adjacent the tensioning head and to apply tension to the string.

4. A stringing apparatus for a racket, comprising:

a common platform base;

a movable racket mounting system disposed on the common platform base;

a linkage mechanism disposed between the racket mounting system and the common platform base;

a tensioning head disposed on one side of the movable racket mounting system;

a standing fixed clamp disposed on another side of the movable racket mounting system; and a movable plate disposed between the racket mounting system and the common platform base, the movable plate being movable along one direction linearly relative to the racket mounting system and the common platform base, wherein the tensioning head and the standing fixed clamp are disposed on the movable plate.

5. A stringing apparatus for a racket, comprising:

a common platform base;

a movable racket mounting system disposed on the common platform base;

a linkage mechanism disposed between the racket mounting system and the common platform base;

a tensioning head disposed on one side of the movable racket mounting system;

a standing fixed clamp disposed on another side of the movable racket mounting system; and a drop weight mechanism having:

a movable support frame on which the tensioning head is disposed; and a drop weight/bar string tension mechanism disposed on the tensioning head, wherein the movable support frame is configured to permit a change to a relative effective distance between the racket mounting system and the drop weight/bar string tension mechanism to achieve a leveling horizontal position of the drop weight/bar.

6. The stringing apparatus of claim 5, wherein the drop weight mechanism further comprises a motor actuator configured to selectively and linearly move the support frame.

7. The stringing apparatus of claim 6, wherein the support frame and the motor actuator are disposed on a common platform base.

8. The stringing apparatus of claim 7, wherein the support frame is slidably disposed on a rail affixed to an upper surface of the common platform base.

9. The stringing apparatus of claim 6, wherein the drop weight mechanism further comprises a control circuit system in electrical communication with the motor actuator and configured to operate the motor actuator.

10. The stringing apparatus of claim 9, wherein the control circuit system is in electrical communication with a DC power supply.

11. The stringing apparatus of claim 9, wherein the control circuit system includes a start-stop switch configured to control an actuation of the motor actuator, and a toggle switch configured to control a direction of movement of the support frame by the motor actuator.

* * * * *